US007762517B1

(12) United States Patent
Leseman

(10) Patent No.: US 7,762,517 B1
(45) Date of Patent: Jul. 27, 2010

(54) ADJUSTABLE PICTURE FRAME HANGER AND ASSOCIATED METHOD

(76) Inventor: Bruce M. Leseman, 29123 N. Juliaetta Gr., Juliaetta, ID (US) 83535

( * ) Notice: Subject to any disclaimer, the term of this patent is extended or adjusted under 35 U.S.C. 154(b) by 318 days.

(21) Appl. No.: 11/728,526

(22) Filed: Mar. 26, 2007

(51) Int. Cl.
*A47G 1/24* (2006.01)

(52) U.S. Cl. ..... 248/489; 248/495; 248/476; 248/475.1

(58) Field of Classification Search ..... 248/489, 248/495, 476, 913, 493, 475.1, 287.1, 124.1
See application file for complete search history.

(56) References Cited

U.S. PATENT DOCUMENTS

| | | | | |
|---|---|---|---|---|
| 779,433 | A * | 1/1905 | Long | 248/495 |
| 3,251,569 | A * | 5/1966 | Rynearson | 248/493 |
| 4,892,284 | A | 1/1990 | Kelrick | |
| 4,976,409 | A | 12/1990 | Hansen | |
| 5,069,411 | A * | 12/1991 | Murphy | 248/476 |
| 5,342,014 | A | 8/1994 | Wilson | |
| 5,806,826 | A * | 9/1998 | Lemire | 248/476 |
| 5,931,439 | A | 8/1999 | Lemire | |
| 5,947,438 | A | 9/1999 | Lemire | |
| 6,003,825 | A | 12/1999 | Abernathy, Jr. | |
| 6,062,525 | A * | 5/2000 | Lemire | 248/475.1 |
| 6,241,210 | B1 | 6/2001 | Brindisi | |
| 6,578,812 | B2 * | 6/2003 | Lemire | 248/551 |
| 6,659,418 | B2 | 12/2003 | Lemire | |
| 6,663,075 | B2 | 12/2003 | Zuller | |
| D506,125 | S | 6/2005 | Munson et al. | |
| 7,011,283 | B2 | 3/2006 | Lemire | |

* cited by examiner

*Primary Examiner*—Anita M King
(74) *Attorney, Agent, or Firm*—Montgomery Patent and Design; Robert C. Montgomery; Joseph T. Yaksich

(57) ABSTRACT

An adjustable picture hanger includes a mounting base that is fastened to the wall using screws or similar fasteners in the general location where the picture or wall hanging is to be hung. Movable inner and outer carriages on the bracket are adjustable in an up/down, and/or left/right directions using two adjustable fastening that allows positioning of the carriage in the X-Y axis. Surface indicia are printed on the mounting base and the outer carriage that define a relative position of said inner and outer carriages so that the user can measure minute distances within a perimeter of said mounting base. Thus, very fine adjustments can be applied to perfectly position any picture or wall hanging.

8 Claims, 5 Drawing Sheets

ADJUSTABLE PICTURE FRAME HANGER AND ASSOCIATED METHOD

RELATED APPLICATIONS

The present invention was first described in Disclosure Document No. 603,469 filed on Jul. 13, 2006 the entire disclosures of which are incorporated herein by reference.

FIELD OF THE INVENTION

This invention relates to picture hanging apparatuses and, more particularly, to an apparatus that allows the adjustment of a picture frame in an up/down and left/right fashion after being attached to a wall surface.

BACKGROUND OF THE INVENTION

No matter how hard one tries, it is extremely difficult to hang a framed picture or item that is hung from a wall perfectly level and in a desired position. The problem rests with the placement of the nails or hanging devices that are used to support the hanging. It is difficult to estimate the position of the hanging device that will produce the proper orientation. As a result, the frame or object rests askew from the desired position, shifted to the left/right, up/down, or slanted diagonally. One then must reposition the nail/hanging device and start over; leaving empty holes in the wall that must be refilled. Accordingly, there is a need for a means by which one can hang a picture or other wall hanging in a desired position with both ease and accuracy.

Several attempts have been made in the past to an apparatus that allows the adjustment of a picture or other wall hanging in an up/down and/or left/right fashion after being attached to a wall surface. U.S. Pat. No. 7,011,283 in the name of Lemire discloses objects hung with the improved hook & cord loop hanging system using one or more adjustable hooks for changing the length of one or more flexible cord loops. Each improved hanger can either be affixed to the object or to the surface the object is being hung on. The cord loop or loops interface with various supports connecting to or affixed to the object or to the surface when the hanger is on the object. The single hook and single cord configuration provides vertical adjustability by shortening the length of the cord through the turning of the screw the adjustable hook is ridding on. A single hook and double cord configuration provides support and locking for the object. A double hook and double cord configuration provides vertical adjustability and locking capability. These hangers can be used alone for small objects or in pairs for larger or heavier objects. Unfortunately, this prior art example uses a corded material that can easily break during use, thus rendering the invention useless for its' intended purpose. In addition, breakage of the cord can result in damage to the object being hung.

U.S. Pat. No. 6,663,075 in the name of Zuller discloses a picture hanger with a height adjustable hook that allows the height of the picture to be adjusted from time to time. The hanger uses a back plate on which two opposed crenellated tracks are positioned. Two spring-biased crenellated cars are housed in a frame and move on the tracks. The hook is attached to the frame. The frame is either a traveling plate which moves between the tracks and the back plate or a traveling block which is slidably mounted in a channel in the back plate and on a rod positioned in the channel of the back plate. Unfortunately, this prior art example only allows adjustment of the hung object along the vertical plane.

U.S. Pat. No. 6,659,418 in the name of Lemire describes picture frames and frame bases attached to pictures that are able to be mounted flush against a wall. Special recessed areas and frame connections make contact with one or more special wall brackets. The wall brackets are anchored into the wall and are connected to the frame in a number of ways. One of the ways is with the use of a screw that has a threaded bar moving on it. The screw goes through the top of the frame and is locked to the inside face of the frame so that it remains in place when the screw is turned. When the screw is turned the threaded bar moves into a recess in the wall bracket and pushes the picture up until the picture bottom hits a second wall bracket. This second bracket locks the picture onto the wall. The embodiments presented demonstrate various other means of locking the picture flush against the wall, as well as, means for leveling and adjusting the position of the picture. Unfortunately, this prior art texample is complicated to use, and requires a multitude of elements be attached to a wall surface for use of the invention.

U.S. Pat. No. 6,241,210 in the name of Brindisi discloses a device that provides adjustable hanging of an item, such as a picture frame, on a vertical support such as a wall. The hanger may provide for automatic, in situ, and/or substantially continuous vertical adjustment, and/or horizontal adjustment. The adjustable hanger may comprise a first portion affixed to the vertical support, and a second portion that engages with the first portion and fixedly attaches to or is incorporated in the reverse side of the item, with one or both of the aforementioned portions being formed to allow automatic, in situ, continuous vertical adjustment and selective locking with respect to the other portion through a clamp, bias, or similar means; one or both these portions may also be formed to allow horizontal adjustment and repositioning with respect to the other portion. Also disclosed is a device for horizontally extending the available range of mounting positions for items that need to be supported by a stud. Unfortunately, the mechanism of this prior art example makes it difficult for a user to adjust the position of an object along the vertical and horizontal plane while the object is hung against a wall surface.

None of the prior art particularly describes an apparatus that allows the adjustment of a picture or other wall hanging in an up/down and left/right fashion after being attached to a wall surface. Accordingly, there is a need for an apparatus which provides such features while overcoming the above-noted shortcomings.

SUMMARY OF THE INVENTION

In view of the foregoing disadvantages inherent in the prior art, it has been observed that there is need for an apparatus that allows the adjustment of a picture or other wall hanging in an up/down and/or left/right fashion after being attached to a wall surface.

The apparatus includes a mounting base removably attached to the wall, and an outer carriage attached to the mounting base that is movable along a horizontal path defined across the mounting base. An inner carriage is attached to the mounting base and is movable along a vertical path defined along the mounting base. Such inner outer and inner carriages allow movement of the object along both the vertical and horizontal planes respectively, which is essential such that a user can easily position an object as desired for maximum aesthetic pleasure. First and second adjustment fasteners are threadably engaged with the outer and inner carriages respectively, and are oriented perpendicular to each other. Such adjustment fasteners allow a user to move an object in minute increments along a wall surface while the object is securely attached to the wall surface.

The mounting base advantageously remains statically attached to the wall when the first and second adjustment fasteners are rotatably biased along clockwise and counter clockwise directions to thereby displace the inner and outer carriages along the respective paths. Such a static attachment of the mounting base to the wall surface advantageously reduces the possibility that the object will become prematurely and undesirably detached from a wall surface while a user manipulates the adjustment fasteners. The inner and outer carriages are independently and simultaneously movable along the respective paths, which is necessary to allow a user to manipulate both adjustment fasteners simultaneously for optimal placement of the hung object.

The mounting base includes a plurality of countersunk mounting holes formed in opposed corners thereof, which is critical for receiving auxiliary fastening members therethrough. A primary mounting hole is formed in a center of the mounting base and is equidistantly spaced from the countersunk mounting holes. Such auxiliary and primary mounting holes provide sufficient support for the object being hung based on the size and weight of same. A plurality of first tapered slots is formed adjacent to top and bottom edges of the mounting base for slidably receiving the outer carriage. An outer carriage guide is located on a right side of the mounting base, and is provided with a first threaded hole for threadably receiving the second adjustment fastener therethrough, which is crucial such that the outer carriage is slidably and horizontally guided along the first tapered slots.

The outer carriage includes a first tapered edge seated within a bottom one of the first tapered slots, a second tapered edge seated within an upper one of the first tapered slots, a central aperture formed along a bottom edge of the outer carriage, and a second tapered slot formed along a bottom edge of the outer carriage. A first attachment hole is formed through a side of the outer carriage, and the second adjustment fastener is threadably received within the first attachment hole, which is vital for providing horizontal movement of the outer carriage. Such tapered slots allow planar movement of the outer carriage during adjustment, and corresponding planar movement of the object attached thereto.

The outer carriage further includes an inner carriage guide advantageously provided with a second attachment hole located above the bottom edge of the outer carriage. The first adjustment fastener is positioned through the second attachment hole for vertically guiding the inner carriage within the second tapered slot. An outer carriage positioning indicator is located along a top center portion of the outer carriage, which is essential for assisting a user to align the outer carriage with outer carriage dimension indicia printed on the mounting base. Inner carriage dimension indicia are printed on a left side of the outer carriage, which is important for illustrating a position of the inner carriage in relation to the outer carriage. Such indicia visually alert a user when the outer and inner carriages are approaching the limits of their respective adjustable ranges. The inner carriage is slidably engaged within the second tapered slot of the outer carriage.

The inner carriage includes a plurality of third tapered edges advantageously formed along a longitudinal length of the inner carriage and engaged with the second tapered slot, a support hook perpendicularly flanging outward from an upper portion of the inner carriage, and an attachment hole formed within a lower portion of the inner carriage and threadably receiving the first adjustment fastener, which is essential to thereby allow the inner carriage to slidably traverse along a vertical path defined along a longitudinal length of the outer carriage.

The apparatus provides the unexpected benefit of allowing a user to attach an object to a wall surface using a minimum of elements, while simultaneously allowing a user to adjust the object along the vertical and horizontal planes respectively while the object is secured to the wall surface. Such advantages overcome the shortcomings described in the above mentioned prior art.

In operation, a method of utilizing an adjustable picture frame hanger includes the steps of selecting a general location on a wall where a picture frame is to be hung, providing a mounting base, inner and outer carriages, and first and second adjustment fasteners respectively, fastening the mounting base to the wall by inserting auxiliary fasteners through countersunk mounting holes formed at each corner and a center of the mounting base respectively, adjusting a position of the outer carriage by rotationally moving the second adjustment fastener such that an outer carriage positioning indicator becomes aligned with a center of outer carriage dimensional indicia printed on the mounting base, and adjusting the inner carriage by rotationally moving the first adjustment fastener such that an inner carriage positioning indicator becomes aligned with a center of inner carriage dimensional indicia printed on the outer carriage.

The steps further include hanging the picture frame wall on an upper portion of a support hook attached to the inner carriage, leveling the picture on the wall by determining vertical and horizontal distances that the inner and outer carriages must be adjusted along the mounting base, removing the picture frame from the support hook, adjusting a horizontal position of the outer carriage by rotating the second adjustment fastener wherein a distance moved is indicated by alignment of the outer carriage positioning indicator with the outer carriage dimensional indicia, adjusting a vertical position of the inner carriage by rotating the first adjustment fastener wherein a distance moved is indicated by alignment of the inner carriage positioning indicator with the inner carriage dimensional indicia, and placing a leveling device on the picture frame to determine if a desired equilibrium level has been achieved.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | mounting hole |
| 11 | first threaded hole |
| 12 | first tapered slot |
| 13 | first tapered edge |
| 14 | second threaded hole |
| 15 | first attachment hole |
| 16 | outer carriage positioning indicator |
| 17 | second tapered slot |
| 18 | inner carriage positioning indicator |
| 19 | support hook |
| 20 | mounting base |
| 21 | first adjustment thumbscrew |
| 22 | second adjustment thumbscrew |
| 23 | second tapered edge |
| 25 | outer carriage |
| 30 | inner carriage |
| 31 | second attachment hole |
| 33 | third tapered edge |
| 35 | outer carriage guide |
| 36 | inner carriage guide |
| 40 | outer carriage dimension indicia |
| 50 | inner carriage dimension indicia |
| 60 | primary mounting hole |
| 100 | adjustable picture frame hanger assembly |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
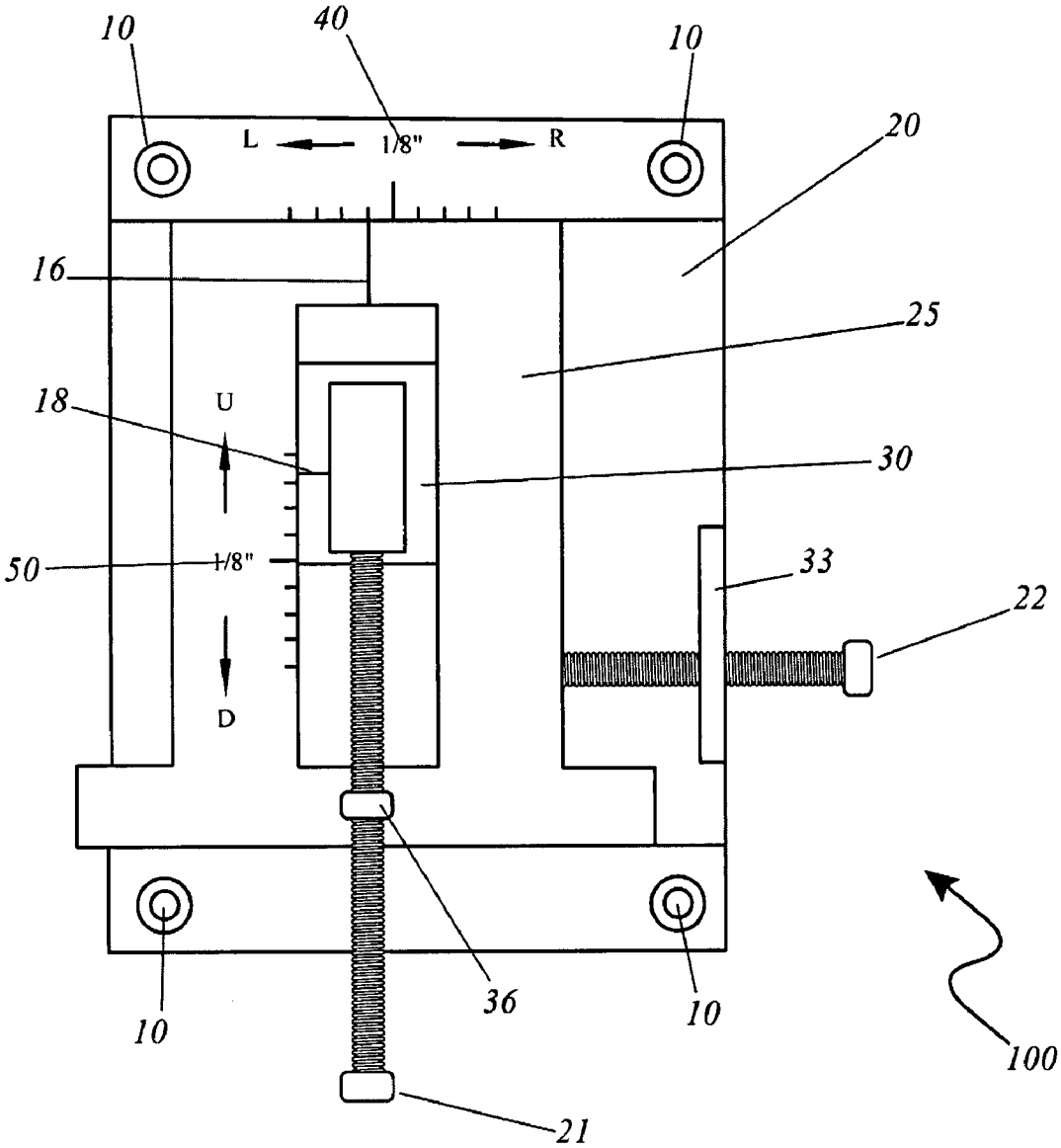
FIG. 1 is an orthogonal view of an adjustable picture frame hanger assembly 100, with a mounting base 20, an outer movable carriage 25 an inner movable carriage 30, according to a preferred embodiment of the present invention.

Referring now to FIG. 1, an adjustable picture frame hanger 100 (herein described as the "apparatus") is depicted in accordance with a preferred embodiment of the present invention. The apparatus 100 provides for the accurate leveling and hanging of pictures and wall hangings and allows for minor movement of the apparatus 100 in a vertical and horizontal direction. The apparatus 100 comprises a mounting base 20, an outer movable carriage 25 for horizontal movement, and an inner movable carriage 30 for vertical movement.

Figure 2A:
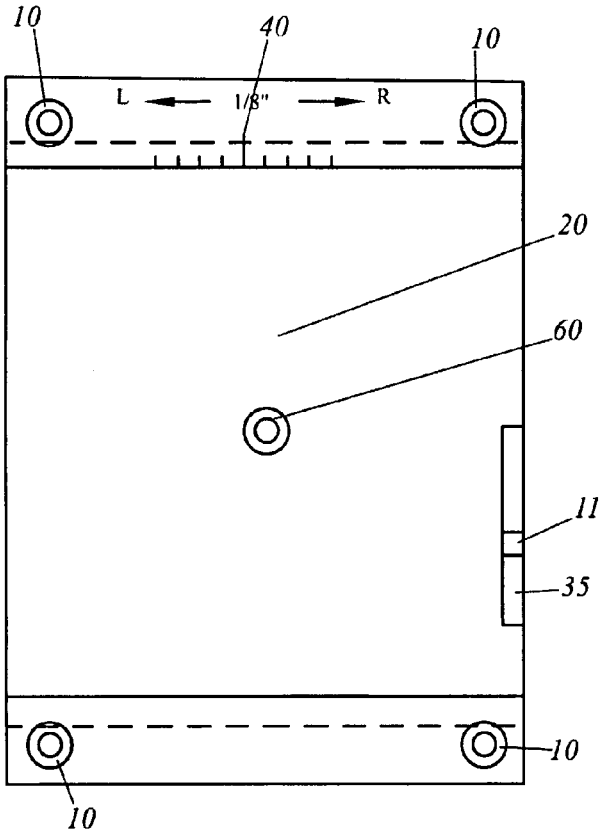
FIG. 2*a*-2*c* are orthogonal views of the mounting base 20 with four (4) countersunk holes 10 for fastening the base 20 to a wall, according to the preferred embodiment of the present invention.
Figure 2B:
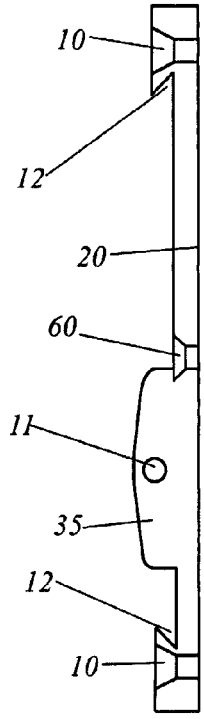
Figure 2C:
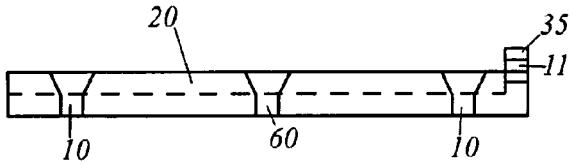

Referring next to FIGS. 2*a* through 2*c*, orthogonal views of the mounting base 20, are herein described. The mounting base 20, secures to the wall through four (4) countersunk mounting holes 10 located in each corner through which screws, bolts, or other fasteners may be used. A primary mounting hole 60 is located in the center of the mounting base 20. A set of first tapered slots 12 slidably receives the outer carriage 25. An outer carriage guide 35 with a first threaded hole 11 is located on the right hand side of the mounting base 20 and threadably receives a second adjustment thumbscrew 22 that guides the outer carriage 25 as it slides horizontally within the first tapered slots 12. Outer carriage dimension indicia 40 are printed along the upper portion of the mounting base 20 to illustrate the position of the outer carriage 25 in relation to the mounting base 20.

Figure 3A:
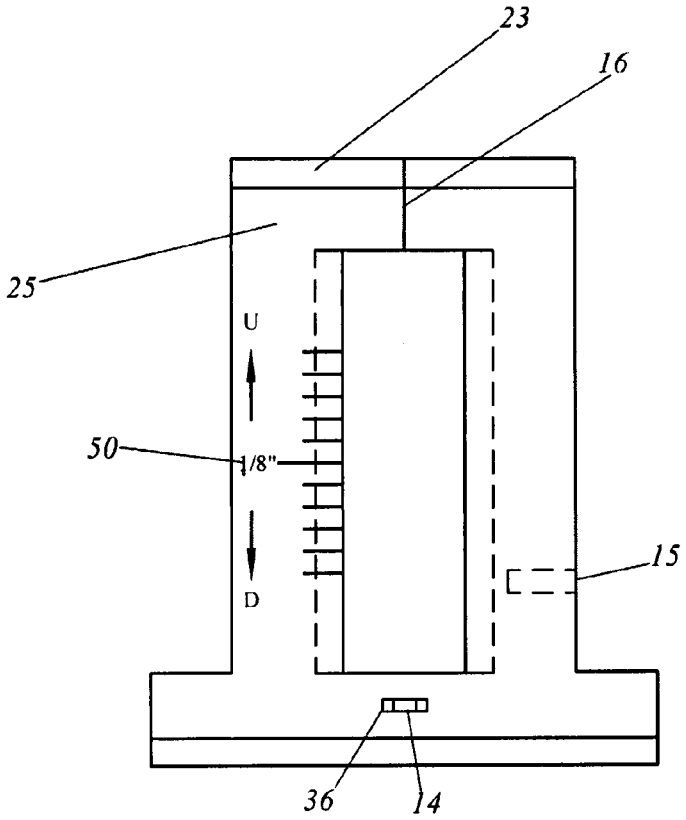
FIG. 3*a*-3*c* are orthogonal views of the outer movable carriage 25, according to the preferred embodiment of the present invention.
Figure 3B:
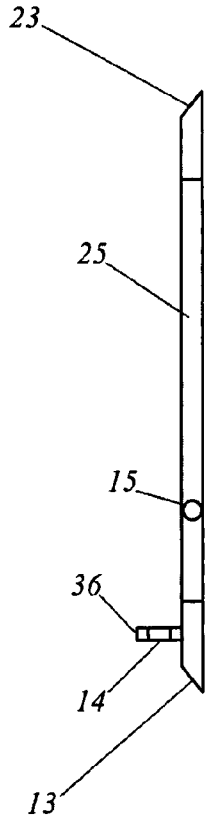
Figure 3C:
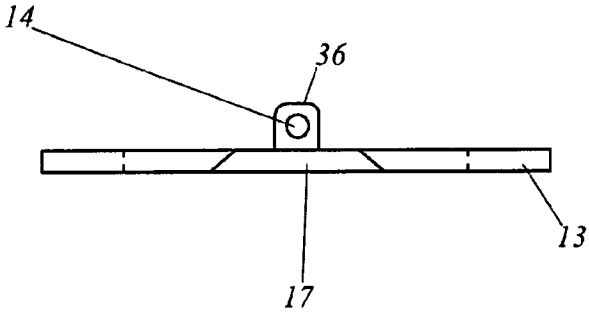

Referring now to FIGS. 3*a* through 3*c*, orthogonal views of the outer carriage 25, are described. The outer carriage 25 is slidably engaged with the first tapered slots 12 of the mounting base 20, wherein a first tapered edge 13 mates with the bottom first tapered slot 12 and is as wide as the mounting base 20, and a second tapered edge 23 mates with the upper first tapered slot 12 and is smaller in width than the mounting base 20. A second tapered slot 17 is formed within both sides of a center aperture. A first attachment hole 15 threadably receives the second adjustment thumbscrew 22 which provides the horizontal movement of the outer carriage 25. An inner carriage guide 36 with a second threaded hole 14 is located on the lower portion of the outer carriage 25 and threadably receives a first adjustment thumbscrew 21 that guides the inner carriage 30 as it slides vertically within the second tapered slot 17. An outer carriage positioning indicator 16 is located in the top center of the outer carriage 25 for lining up with the outer carriage dimension indicia 40 on the mounting base. Printed on the left side of the center aperture are inner carriage dimension indicia 50 to illustrate the position of the inner carriage 30 in relation to the outer carriage 25.

Figure 4A:
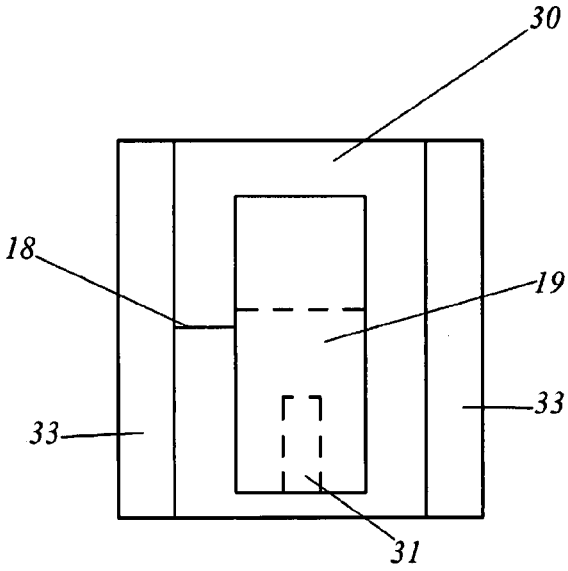
FIG. 4*a*-4*c* are orthogonal views of the inner movable carriage 30, according to the preferred embodiment of the present invention; and, FIG. 5 is an orthogonal view of the adjustment thumbscrews 21, 22, according to the preferred embodiment of the present invention.
Figure 4B:
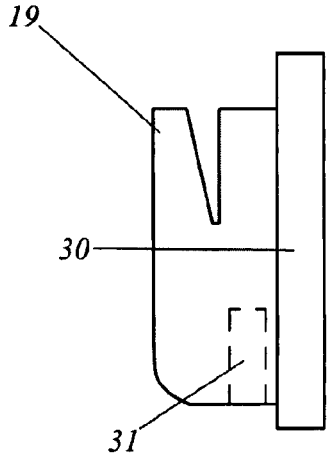
Figure 4C:
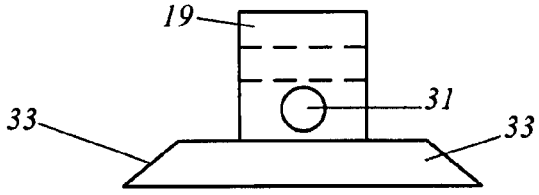

Referring now to FIGS. 4*a* through 4*c*, orthogonal views of the inner carriage 30, is herein described. The inner carriage 30 is slidably engaged within the second tapered slot 17 of the outer carriage 25, wherein a set of third tapered edges 33 engages said second tapered slot 17 located within the central aperture of the outer carriage 25. A support hook 19 flanges perpendicularly outward and engages the device that is to be hanged on the upper portion, while at the lower portion a second attachment hole 31 threadably receives the first adjustment thumbscrew 21 for slidably adjusting the inner carriage 30 within the outer carriage 25.

Figure 5:
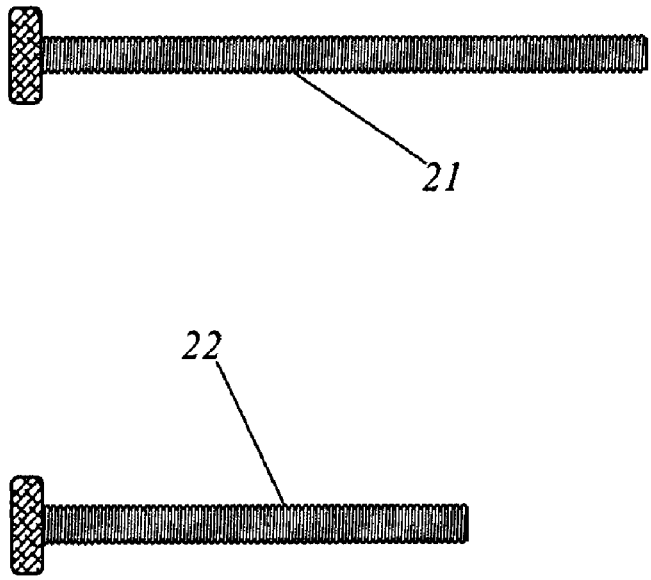

FIG. 5 illustrates the first adjustment thumbscrew 21 and the second adjustment thumbscrew 22. These thumbscrews 21, 22, control the vertical and horizontal placements of the picture, respectively.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition, the apparatus 100 will be configured as in FIG. 1.

The method of utilizing the adjustable picture frame hanger 100 may be achieved by performing the following steps: selecting the general location where the picture or wall hanging is to be hung; fastening the apparatus 100 to the wall with conventional fasteners therethrough the countersunk mounting holes 10 on each corner and therethrough the primary mounting hole 60 in the center of the mounting base 20; adjusting the outer carriage 25 with the rotational movement of the second adjustment thumbscrew 22 such that the outer carriage positioning indicator 16 is aligned with the center of the scales of the outer carriage dimensional indicia 40; adjusting the inner carriage 30 with the rotational movement of the first adjustment thumbscrew 21 such that the inner carriage positioning indicator 18 is aligned with the center of the scales of the inner carriage dimensional indicia 50; placing or hanging the desired picture or wall hanging from the upper portion of the support hook 19 of the inner carriage 30; placing a small bubble level on top of the desired picture or wall hanging and determining if it is level and in the desired location on the wall; determining the vertical and horizontal distances that the apparatus 100 must be adjusted in order to achieve the exact desired position; removing the picture or wall hanging from the support hook 19; adjusting the horizontal position by rotating the second adjustment thumbscrew 22, wherein the distance moved is indicated by alignment of the outer carriage positioning indicator 16 to the scales of the inner carriage dimensional indicia 40; adjusting the vertical position by rotating the first adjustment thumbscrew 21, wherein the distance moved is indicated by alignment of the inner carriage positioning indicator 18 to the scales of the inner carriage dimensional indicia 50; placing the bubble level again on the picture frame or wall hanging to determine if it is level; and, repeating the above procedures if repositioning is needed or desired.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A picture frame hanger for accurately leveling and hanging a picture frame on a wall, said picture frame hanger comprising:

a mounting base removably attached to the wall, further comprising:

a plurality of countersunk mounting holes formed in opposed corners of said mounting base for receiving auxiliary fastening members therethrough;

a primary mounting hole formed in a center of said mounting base and being equidistantly spaced from said countersunk mounting holes;

a plurality of first tapered slots formed adjacent to top and bottom edges of said mounting base for slidably receiving the outer carriage; and, an outer carriage guide located on a right side of said mounting base, said outer carriage guide being provided with a first threaded hole for threadably receiving said second adjustment fastener therethrough in such a manner that said outer carriage is slidably and horizontally guided along said first tapered slots;

an outer carriage attached to said mounting base and being movable along a horizontal path defined across said mounting base;

an inner carriage attached to said mounting base and being movable along a vertical path defined along said mounting base; and, first and second adjustment fasteners threadably engaged with said outer and inner carriages respectively;

wherein said mounting base remains statically attached to the wall when said first and second adjustment fasteners are rotatably biased along clockwise and counter clockwise directions to thereby displace said inner and outer carriages along said respective paths;

wherein said inner and outer carriages are independently and simultaneously movable along said respective paths.

2. The picture frame hanger of claim 1, wherein said outer carriage comprises:

a first tapered edge seated within a bottom one of said first tapered slots;

a second tapered edge seated within an upper one of said first tapered slots;

a central aperture formed along a bottom edge of said outer carriage;

a second tapered slot formed along a bottom edge of said outer carriage; and, a first attachment hole formed through a side of said outer carriage, said second adjustment fastener being threadably received within said first attachment hole for providing horizontal movement of said outer carriage.

3. The picture frame hanger of claim 2, wherein said outer carriage further comprises:

an inner carriage guide provided with a second attachment hole located above said bottom edge of said outer carriage, said first adjustment fastener being positioned through said second attachment hole for vertically guiding said inner carriage within said second tapered slot;

an outer carriage positioning indicator located along a top center portion of said outer carriage for assisting a user to align said outer carriage with outer carriage dimension indicia printed on said mounting base; and, inner carriage dimension indicia printed on a left side of said outer carriage for illustrating a position of said inner carriage in relation to said outer carriage;

wherein said inner carriage is slidably engaged within said second tapered slot of said outer carriage.

4. The picture frame hanger of claim 3, wherein said inner carriage comprises:

a plurality of third tapered edges formed along a longitudinal length of said inner carriage and engaged with said second tapered slot;

a support hook perpendicularly flanging outward from an upper portion of said inner carriage; and, an attachment hole formed within a lower portion of said inner carriage and threadably receiving said first adjustment fastener to thereby allows said inner carriage to slidably traverse along a vertical path defined along a longitudinal length of said outer carriage.

5. A picture frame hanger for accurately leveling and hanging a picture frame on a wall, said picture frame hanger comprising:

a mounting base removably attached to the wall, further comprising:

a plurality of countersunk mounting holes formed in opposed corners of said mounting base for receiving auxiliary fastening members therethrough;

a primary mounting hole formed in a center of said mounting base and being equidistantly spaced from said countersunk mounting holes;

a plurality of first tapered slots formed adjacent to top and bottom edges of said mounting base for slidably receiving the outer carriage; and, an outer carriage guide located on a right side of said mounting base, said outer carriage guide being provided with a first threaded hole for threadably receiving said second adjustment fastener therethrough in such a manner that said outer carriage is slidably and horizontally guided along said first tapered slots;

an outer carriage attached to said mounting base and being movable along a horizontal path defined across said mounting base;

an inner carriage attached to said mounting base and being movable along a vertical path defined along said mounting base; and, first and second adjustment fasteners threadably engaged with said outer and inner carriages respectively, wherein said first and second adjustable fasteners are oriented perpendicular to each other;

wherein said mounting base remains statically attached to the wall when said first and second adjustment fasteners are rotatably biased along clockwise and counter clockwise directions to thereby displace said inner and outer carriages along said respective paths;

wherein said inner and outer carriages are independently and simultaneously movable along said respective paths.

6. The picture frame hanger of claim 5, wherein said outer carriage comprises:

a first tapered edge seated within a bottom one of said first tapered slots;

a second tapered edge seated within an upper one of said first tapered slots;

a central aperture formed along a bottom edge of said outer carriage;

a second tapered slot formed along a bottom edge of said outer carriage; and, a first attachment hole formed through a side of said outer carriage, said second adjustment fastener being threadably received within said first attachment hole for providing horizontal movement of said outer carriage.

7. The picture frame hanger of claim 6, wherein said outer carriage further comprises:

an inner carriage guide provided with a second attachment hole located above said bottom edge of said outer carriage, said first adjustment fastener being positioned through said second attachment hole for vertically guiding said inner carriage within said second tapered slot;

an outer carriage positioning indicator located along a top center portion of said outer carriage for assisting a user to align said outer carriage with outer carriage dimension indicia printed on said mounting base; and, inner carriage dimension indicia printed on a left side of said outer carriage for illustrating a position of said inner carriage in relation to said outer carriage;

wherein said inner carriage is slidably engaged within said second tapered slot of said outer carriage.

8. The picture frame hanger of claim 7, wherein said inner carriage comprises:

a plurality of third tapered edges formed along a longitudinal length of said inner carriage and engaged with said second tapered slot;

a support hook perpendicularly flanging outward from an upper portion of said inner carriage; and, an attachment hole formed within a lower portion of said inner carriage and threadably receiving said first adjustment fastener to thereby allows said inner carriage to slidably traverse along a vertical path defined along a longitudinal length of said outer carriage.

* * * * *